US010407265B1

(12) United States Patent
Liles

(10) Patent No.: US 10,407,265 B1
(45) Date of Patent: Sep. 10, 2019

(54) TAPE PROTECTOR

(71) Applicant: Max Liles, Webb City, MO (US)

(72) Inventor: Max Liles, Webb City, MO (US)

( * ) Notice: Subject to any disclaimer, the term of this patent is extended or adjusted under 35 U.S.C. 154(b) by 7 days.

(21) Appl. No.: 15/627,772

(22) Filed: Jun. 20, 2017

Related U.S. Application Data

(60) Provisional application No. 62/352,589, filed on Jun. 21, 2016.

(51) Int. Cl.

| | |
|---|---|
| ***B65H 16/02*** | (2006.01) |
| ***B65H 75/14*** | (2006.01) |
| ***B65H 75/02*** | (2006.01) |
| ***B65H 75/00*** | (2006.01) |
| ***B65H 19/00*** | (2006.01) |
| *B65H 19/12* | (2006.01) |
| *B65H 19/10* | (2006.01) |
| *B65H 19/30* | (2006.01) |

(52) U.S. Cl.
CPC ..... *B65H 16/02* (2013.01); *B65H 75/00* (2013.01); *B65H 75/02* (2013.01); *B65H 75/14* (2013.01); *B65H 75/141* (2013.01); *B65H 19/00* (2013.01); *B65H 19/10* (2013.01); *B65H 19/12* (2013.01); *B65H 19/30* (2013.01)

(58) Field of Classification Search
CPC .... B65H 75/14; B65H 75/141; B65H 75/143; B65H 75/245; B65H 75/4471; B65H 75/00; B65H 75/02; B65H 75/12; B65H 75/025; B65H 75/22; B65H 75/24; B65H 2701/514; B65H 2701/53; B65H 2701/51; B65H 16/00; B65H 16/005; B65H 16/02; B65H 18/02; B65H 18/28; B65H 19/00; B65H 19/10; B65H 19/12; B65H 18/1857; B65H 19/30; G11B 23/045; G11B 23/037
USPC ..... 242/118.32, 610.6, 583, 597, 600, 601, 242/604, 608.7, 614, 588.3, 129
See application file for complete search history.

(56) References Cited

U.S. PATENT DOCUMENTS

| | | | | |
|---|---|---|---|---|
| 4,634,076 | A * | 1/1987 | Eckert | B65H 75/14 206/403 |
| 4,762,586 | A | 8/1988 | Wilkie | |
| 4,802,638 | A * | 2/1989 | Burger | B65H 75/143 242/388.1 |
| 5,961,063 | A * | 10/1999 | Parry | B65H 16/005 242/422.4 |
| 6,478,068 | B1 | 11/2002 | Brown | |
| 7,021,356 | B2 | 4/2006 | Kelders et al. | |
| 8,944,131 | B1 | 2/2015 | Williams | |

(Continued)

*Primary Examiner* — Michael R Mansen
*Assistant Examiner* — Raveen J Dias
(74) *Attorney, Agent, or Firm* — Margaret Millikin

(57) ABSTRACT

A reusable, one-piece, rubberized tape protector cover for a roll of tape that fits snugly onto the roll to protect its edges from coming into contact with dirt or moisture that might be on the floor. The device has a spindle of varying widths to accommodate different thicknesses of tape and two parallel side walls that extend outward from the spindle in wheel-like fashion. The device is installed on a roll of tape by compressing one of the two side walls and then pushing the compressed side wall through the hollow center of the roll of tape before releasing it. When released, the side wall resumes its former shape. In this installed position, the spindle is located within the hollow part of the roll of tape and the two parallel side walls extend on either side of the roll of tape and hug the side edges of the tape.

11 Claims, 3 Drawing Sheets

(56) References Cited

U.S. PATENT DOCUMENTS

| | | | | |
|---|---|---|---|---|
| 2002/0145073 | A1* | 10/2002 | Swanson | A61F 15/002 242/588.3 |
| 2004/0099762 | A1* | 5/2004 | Shiga | B65H 75/14 242/614 |
| 2004/0140391 | A1* | 7/2004 | Saliba | G11B 23/044 242/614 |
| 2006/0151654 | A1* | 7/2006 | Pitcher | B65H 75/143 242/407 |
| 2011/0036676 | A1* | 2/2011 | Skillman | B65H 75/143 191/12.4 |
| 2016/0229660 | A1* | 8/2016 | Ronnie | B65H 75/143 |

* cited by examiner

TAPE PROTECTOR

CROSS-REFERENCE TO RELATED APPLICATIONS

The present application claims priority to U.S. Provisional Patent Application No. 62/352,589 filed on Jun. 21, 2016 for Tape Protector.

BACKGROUND OF THE INVENTION

1. Field of the Invention

The present invention is a tape protector that fits around a roll of tape to protect the edges of the tape from coming into contact with water or debris that might be on the floor. This tape protector is particularly suited for use on masking tape.

2. Description of the Related Art

In the auto collision repair industry, the shop worker uses a roll of masking tape to apply tape and masking paper to the automobile body. Often this work is done in a shop or other location where the floor is not perfectly clean and may have debris, dirty or moisture on the floor surface. One of the problems that occurs is that the worker will drop the roll of tape and when it hits the floor, the roll of the tape will adhere the dust, debris or moisture onto the edges of the tape thereby making that roll of tape unusable for further application to the automobile body. Rolls of tape that have fallen on the floor must then be discarded, wasting valuable product and costing the shop owner unnecessary money to complete the job.

The present invention addresses this problem by providing a cover for a roll of tape that fits snuggly onto the roll and protects the edges of the tape from coming into contact with dirty or moist surfaces, protecting the tape even when the roll is dropped onto the floor. Further, the present invention can be reused. It is made from a flexible, rubberized material so that it can easily be compressed and inserted through the center of a roll of tape to install it onto a roll and so that it can also be easily removed from an empty roll. Because it is made of a rubberized material, if it becomes dirty, it can be cleaned without harming the device.

SUMMARY OF THE INVENTION

The present invention is a tape protector cover for a roll of tape that fits snuggly onto the roll and protects the edges of the tape from coming into contact with dirty or moist surfaces, protecting the tape even when the roll is dropped onto the floor. The present invention can be reused. It is made from a flexible, rubberized material so that it can easily be compressed and inserted through the center of a roll of tape to install it onto a roll and so that it can also be easily removed from an empty roll. Because it is made of a rubberized material, if it becomes dirty, it can be cleaned without harming the device.

The device is a one piece device in the shape of a spool. The device is flexible and is designed to flex so that one of its two parallel side walls can fit through the center of a roll of tape.

Once through the center, the flexed side wall is allowed to resume its original shape so that the two parallel side walls extending on either side of the roll of tape hug the sides of the tape to protect the side edges of the tape.

The two parallel side walls connect together via a spindle of varying widths to accommodate different thicknesses of tape that is somewhat smaller in outside diameter than an inside diameter of a roll of tape on which the device is to be installed. The two parallel side walls extend outward from the spindle in wheel-like fashion. The side walls extend a sufficient distance to completely cover the side edges of a full roll of tape and are spaced apart from each other a distance that is approximately equal to the width of the roll of tape so that the two parallel side walls sandwich the roll of tape between them when installed on a roll of tape.

DETAILED DESCRIPTION OF THE PREFERRED EMBODIMENT

Figure 1:
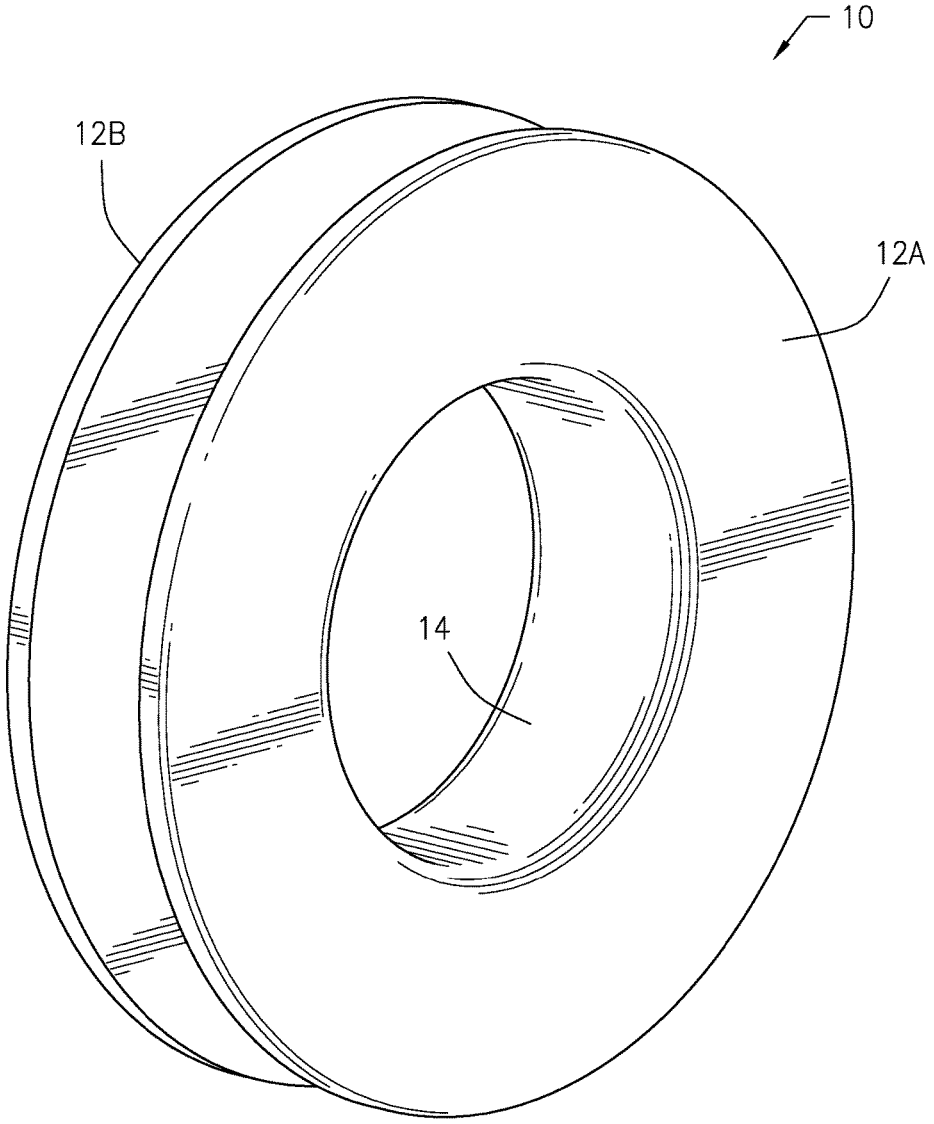
FIG. 1 is a perspective frontal view of a tape protector cover that is constructed in accordance with a preferred embodiment of the present invention.
Figure 2:
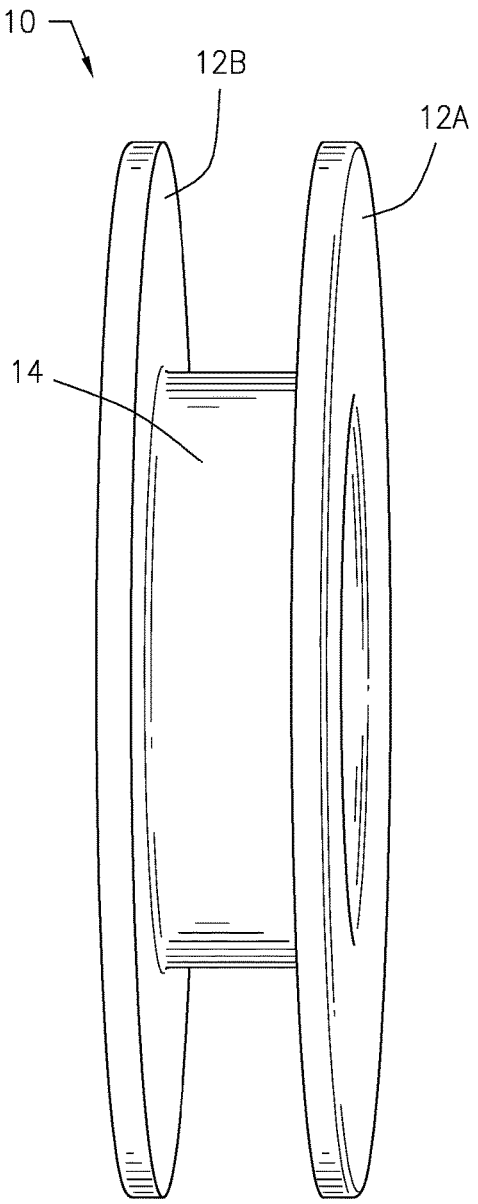
FIG. 2 is a perspective side view of the tape protector cover of FIG. 1.
Figure 3:
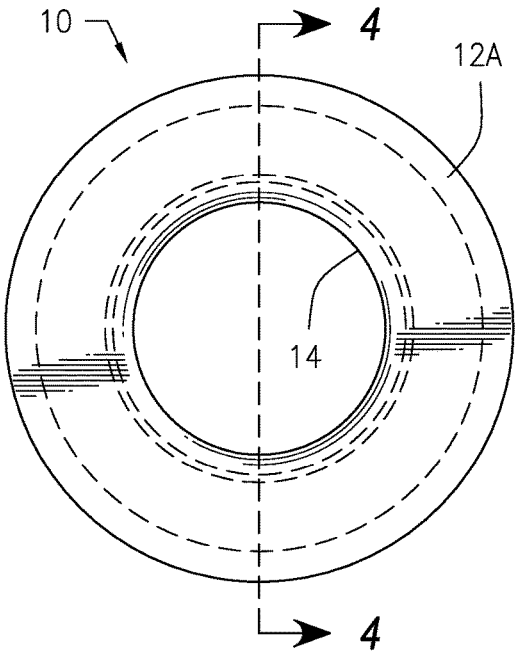
FIG. 3 is a side view of the tape protector cover of FIGS. 1 and 2.
Figure 4:
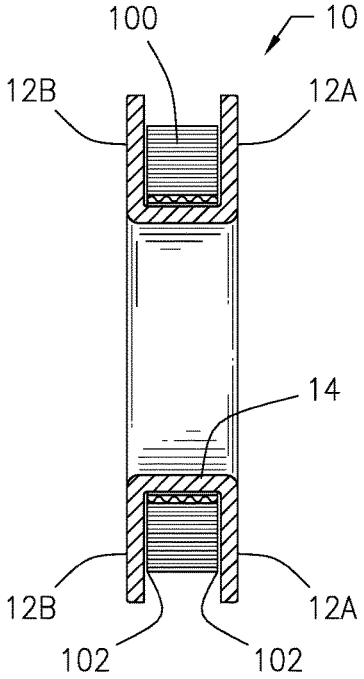
FIG. 4 is a cross sectional view of the tape protector cover taken along line 4-4 of FIG. 3 and shown installed on a roll of tape.
Figure 5A:
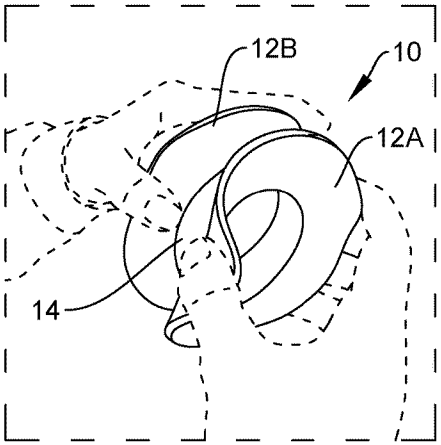
FIG. 5A shows the parallel side walls of the tape protector cover of the present invention in a flexed position away from the spindle in preparation for installation on a roll of tape.
Figure 5B:
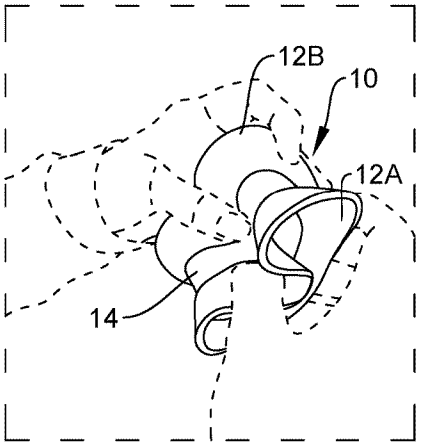
FIG. 5B shows the tape protector cover of the present invention being compressed in preparation for installation on a roll of tape.
Figure 5C:
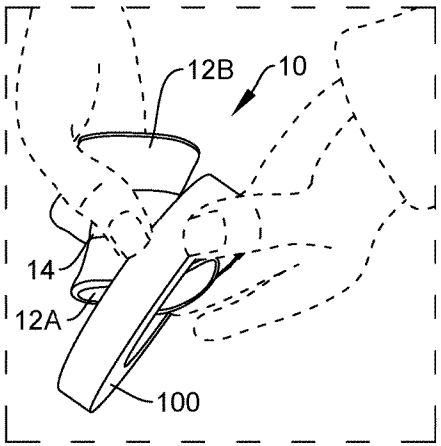
FIG. 5C shows the tape protector cover of the present invention in a compressed state and being inserted through the center of a roll of tape.
Figure 5D:
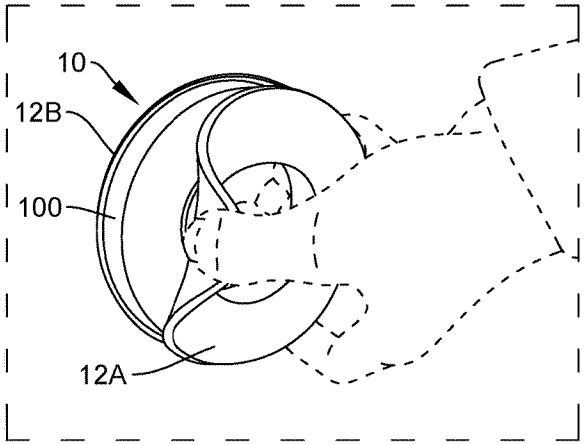
FIG. 5D shows the taper protector cover of the present invention in the final stages of installation on a roll of tape.

Referring now to the drawings and initially to FIGS. 1 and 2, there is illustrated a tape protector cover 10 for use with a roll of tape 100 that is constructed in accordance with a preferred embodiment of the present invention. As illustrated in FIG. 4, the cover fits snuggly onto the roll of tape 100 and protects the edges 102 of the tape 100 from coming into contact with dirty or moist surfaces, thereby protecting the edges 102 even when the roll 100 is dropped onto a dirty or wet floor.

The cover 10 is reuseable. It is made from a flexible, rubberized material that can easily be compressed and inserted through the center of a roll of tape 100 to install it onto the roll 100 and can easily be removed from an empty roll 100. Because it is made of a rubberized material, if it becomes dirty, it can be cleaned without harming the cover 10.

The cover 10 is a one piece device in the shape of a spool. The two parallel side walls 12A and 12B connect together via a spindle 14 of varying widths to accommodate different thicknesses of tape, the spindle 14 being somewhat smaller in outside diameter than an inside diameter of a roll of tape 100 on which the cover 10 is to be installed. The two parallel side walls 12A and 12B extend outward from the spindle 14 in wheel-like fashion. The side walls 12A and 12B extend a sufficient distance to completely cover the side edges 102 of a full roll of tape 100 and are spaced apart from each other a distance that is approximately equal to the width of the roll of tape 100 so that the two parallel side walls 12A and 12B sandwich the roll of tape 100 between them when the cover 10 when installed on a roll of tape 100.

The cover 10 is compressed and is designed to flex so that one of its two parallel side walls 12A or 12B can fit through a hollow center of a roll of tape 100. Once through the center of the roll of tape 100, the compressed side wall 12A or 12B is released and allowed to resume its original shape to complete installation of the cover 10 on the roll 100.

When the cover 10 is installed, the spindle 14 is located within the hollow center of the roll of tape 100 and the two parallel side walls 12A and 12B extending on either side of the roll 100 hug and protect the side edges 102 of the tape 100.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A unitary reusable tape protector cover for installation on a roll of tape, the roll of tape having side edges and a center void having an inside diameter, the tape protector cover comprising:

a central spindle having a first end, a second end and a width, wherein the width of the central spindle is defined as the length of the spindle between the first end and the second end and the width of the spindle is less than the inside diameter of the center void of the roll of tape; and two parallel planate side walls adjoining the central spindle, wherein:

a first one of the two parallel planate side walls extends radially from the first end of the central spindle in a wheel-like fashion;

a second one of the two parallel planate side walls extends radially from the second end of the central spindle in a wheel-like fashion;

and the two parallel planate side walls each extend radially from the central spindle a distance to cover the side edges of the roll of tape and to sandwich the roll of tape therebetween when installed on the tape protector cover; and wherein the tape protector cover is a unitary piece of flexible material adapted to be compressed and inserted through center void of the roll of tape for installation thereon.

2. A unitary reusable tape protector cover according to claim 1 wherein the width of the central spindle varies to accommodate rolls of tape of different thicknesses.

3. The unitary reusable tape protector cover of claim 1 further comprising a roll of tape.

4. A unitary reusable tape protector cover for installation on a roll of tape, the roll of tape having side edges and a center void having an insides diameter, the tape protector cover comprising:

a flexible, rubberized spool shaped piece of material comprising:

a central spindle having a first end, a second end and a width, wherein the width of the central spindle is defined as the length of the spindle between the first end and the second end and the width of the central spindle is less than the inside diameter of the center void of the roll of tape; and two parallel planate side walls adjoining the central spindle, wherein:

a first one of the two parallel planate side walls extends radially from the first end of the central spindle in a wheel-like fashion without curving;

a second one of the two parallel planate side walls extends radially from the second end of the central spindle in a wheel-like fashion without curving; and the two parallel planate side walls are spaced apart from each other on the central spindle a distance that is equal to the width of the central spindle; and the two parallel planate side walls each extend radially from the central spindle a distance to completely cover the side edges of the roll of tape without enclosing the roll of tape; wherein the tape protector cover is a unitary piece of flexible material adapted to be compressed and inserted through the center void of the roll of tape for installation thereon.

5. A unitary reusable tape protector cover according to claim 4 wherein the width of the central spindle varies to accommodate rolls of tape of different thicknesses.

6. The unitary reusable tape protector cover of claim 4 further comprising a roll of tape.

7. A method of protecting the side edges of a roll of tape, the roll of tape having a center void, with a spool shaped reuseable tape protector cover having a central spindle and two parallel planate side walls extending radially from the central spindle without curving, the method comprising the steps of:

compressing a first one of the two parallel planate side walls;

inserting the compressed first one of the two parallel planate side walls through the center void of the roll of tape;

releasing the first one of the two parallel planate side walls so that the central spindle is located within the center void of the roll of tape and the two parallel planate side walls extending radially from the central spindle cover the side edges of the roll of tape to protect the side edges of the roll of tape.

8. The method of claim 7 wherein the step of compressing a first one of the two parallel planate side walls further comprises compressing the first one of the planate side walls away from the central spindle.

9. The method of claim 7 further comprising the step of compressing a second one of the two parallel planate side walls.

10. The method of claim 9 wherein the step of compressing the second one of the two parallel planate side walls further comprises compressing the second one of the planate side walls away from the central spindle.

11. The method of claim 9 further comprising the step of releasing the second one of the two parallel planate side walls so that the central spindle is located within the center void of the roll of tape and the two parallel planate side walls extending radially from the central spindle cover the side edges of the roll of tape to protect the side edges of the roll of tape.

* * * * *